US005090198A

United States Patent [19]

Nightingale et al.

[11] Patent Number: 5,090,198

[45] Date of Patent: Feb. 25, 1992

[54] MOUNTING ASSEMBLY

[75] Inventors: Douglas J. Nightingale, Jonesboro; Martyn G. Roberts, Roswell, both of Ga.; Paul Newman, Bristol, England

[73] Assignee: Rolls-Royce Inc. & Rolls-Royce plc, England

[21] Appl. No.: 519,156

[22] Filed: May 4, 1990

[51] Int. Cl.[5] ..... F02K 3/08

[52] U.S. Cl. ..... 60/261; 60/39.32

[58] Field of Search ..... 416/221, 220 R, 219 R, 416/206, 207, 215, 248, 500, 241 B; 415/135, 108, 174.2, 173.3; 60/261, 39.32

[56] References Cited

U.S. PATENT DOCUMENTS

| | | | |
|---|---|---|---|
| 3,567,337 | 3/1971 | Zerlauth et al. | 416/221 |
| 4,417,854 | 11/1983 | Cain et al. | 416/241 B |
| 4,505,640 | 3/1985 | Hsing et al. | 416/220 R |
| 4,897,021 | 1/1990 | Chaplin et al. | 415/174.2 |

*Primary Examiner*—Louis J. Casaregola
*Assistant Examiner*—Laleh Jalali
*Attorney, Agent, or Firm*—Oliff & Berridge

[57] ABSTRACT

A reheat system for a gas turbine engine includes a plurality of radial flameholders constructed of non-metallic material, such as a ceramic composite or carbon/-carbon reinforced material, mounted on a metallic support structure in the engine jet pipe. The metallic support structure may be cooled by air from the engine bypass duct, and the non-metallic flameholders are capable of withstanding higher exhaust gas temperatures in the jet exhaust beyond the capability of currently used metal alloy materials. However, the mounting assembly must be capable of absorbing the considerable differential thermal expansion which will take place. Accordingly, the non-metallic flameholders are mounted on the metallic structure by means of dovetail mounting assemblies a clearance distance is provided between opposing end faces of the dovetail mounting assemblies into which is sprung a compressible resilient member which urges mounting faces of the dovetail assemblies into engagement but which is able to absorb differential thermal expansion and a degree of misalignment in the assemblies.

14 Claims, 2 Drawing Sheets

MOUNTING ASSEMBLY

BACKGROUND OF THE INVENTION

The invention relates to a mounting assembly and, in particular, to an assembly for mounting a component with respect to a support structure possessing a relatively high coefficient of differential thermal expansion. The invention concerns especially a dovetail mounting assembly for a ceramic or ceramic composite material flameholder in the reheat system of a gas turbine engine.

Future gas turbine engines will operate in the interests of greater efficiency at higher turbine exit temperatures. For engines using reheat systems this will require certain components such as flameholders which project into the gas stream in the combustion region to be constructed of material tolerant of the temperatures beyond the capabilities of presently known alloys. It is proposed to employ materials such as ceramic and carbon/carbon composite materials. It is to be appreciated however, that the invention will find wider application than merely in respect of gas turbine engine components.

Materials such as those mentioned above are possessed of substantially lower coefficients of thermal expansion than metal and metal alloys. Mechanical problems of mounting and stressing therefore arise when ceramic, composite or the like components have to be attached to metal components.

SUMMARY OF THE INVENTION

It is an object of the present invention to provide a mounting assembly which overcomes these drawbacks.

According to one aspect of the invention there is provided a mounting assembly for joining together components of substantially different thermal expansion rates comprising a first component formed with a dovetail recess and a second component formed with a dovetail projection, and resilient means interposed between opposing end faces of the recess and the projection and operative to continue to urge the locating faces of the dovetail assembly into engagement over a broad temperature range while absorbing differential thermal expansion.

In a preferred embodiment of the invention the resilient means comprises a resilient metal annular member having a 'C' shaped transverse section which is sprung into the recess to provide a predetermined preload to maintain contact between the dovetail faces.

According to another aspect of the invention there is provided a mounting assembly for mounting a non-metallic ceramic, carbon/carbon or the like component on a metallic structure comprising a metallic component formed with a dovetail recess and a non-metallic component with a dovetail projection, and resilient means interposed between opposing end faces of the recess and the projection and operative to urge the locating faces of the dovetail joint into engagement.

According to a third aspect of the invention there is provided a gas turbine engine having a jet pipe containing a reheat system comprising an annular metallic support structure mounted in the jet pipe and formed with a plurality of dovetail recesses spaced apart around the structure, a plurality of non-metallic flameholders each having a shaped elongate member having at one end a dovetail projection, each dovetail projection being assembled with a dovetail recess whereby to mount the flameholder in the jet pipe on the support structure together with resilient means compressively inserted between opposing end faces of each of the dovetail joints formed thereby to urge the locating faces of the dovetail joints into engagement.

BRIEF DESCRIPTION OF THE EMBODIMENTS

The invention and how it may be carried into practice will now be described with reference, by way of example only, to the accompanying drawings in which.

DESCRIPTION OF THE PREFERRED EMBODIMENTS

Figure 1:
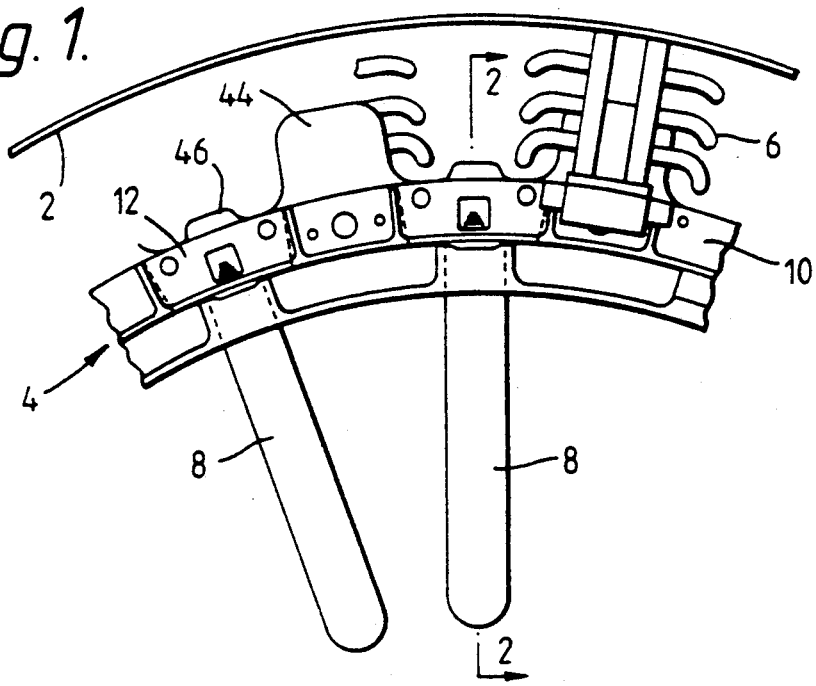
FIG. 1 shows a view looking downstream, of part of a reheat system.

Referring to the drawings: FIG. 1 shows a transversely sectioned view of part of a reheat system in the jet pipe of a gas turbine engine seen from the upstream side looking in an axial direction towards the final exhaust nozzle. Part of the circumference of the jet pipe liner is indicated at 2 and at 4 there is drawn a part of an annular support structure for mounting a reheat system. The reheat system is not shown in its entirety; the manifolding and fuel supply pipes are omitted completely as these form no part of the invention. The reheat fuel injector outlets are schematically illustrated at 6 for reference, and two of a whole circular array of radial flameholders are referenced at 8.

Figure 2:
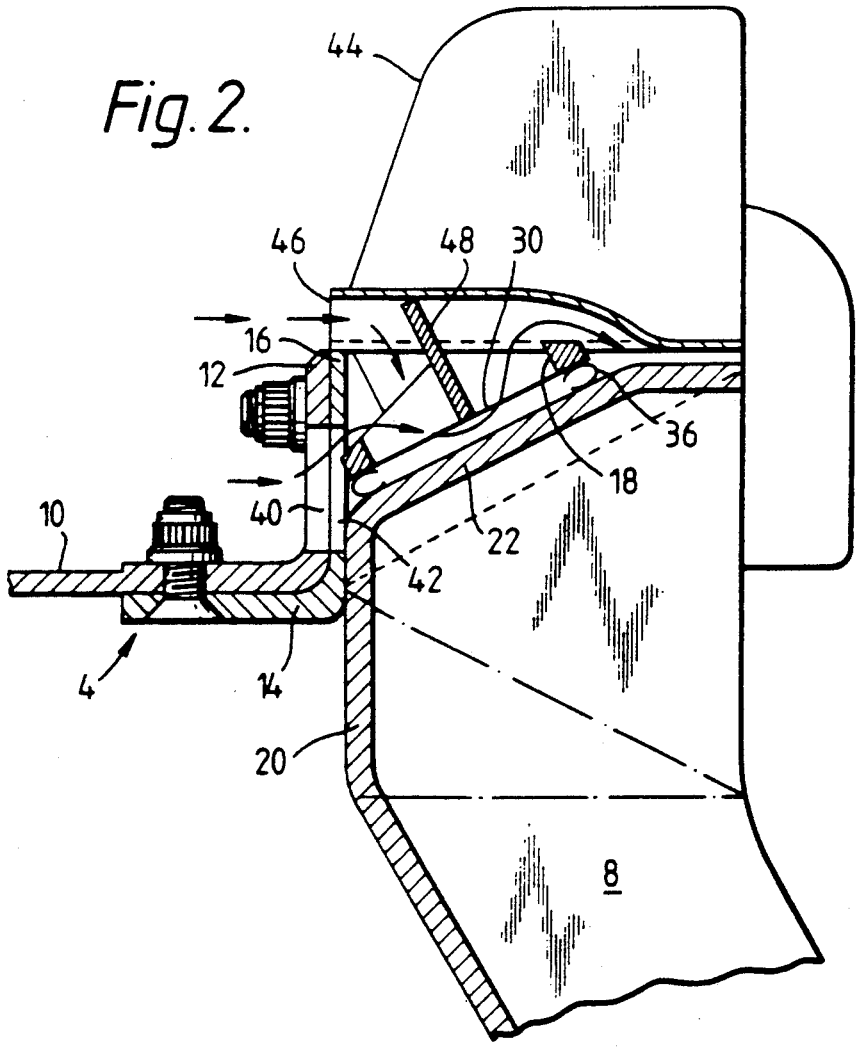
FIG. 2 shows a view on section 2—2 in FIG. 1.

In the engine of present interest the reheat support annulus 4 is constructed of metal and is attached to the rearward, i.e. downstream, end of a fixed turbine exit nozzle the extremity of which is shown at 10 in FIG. 2. In all the drawings, for ease of reference, like parts have been given like reference numerals. The flameholders 8 are formed of carbon/carbon, ceramic composite or similar non-metallic material having a substantially lower coefficient of thermal expansion than is possessed by the metallic support structure 4. The flameholders 8 are suspended from the support structure 4 pointing radially inwards towards the axis of the engine, and therefore project into the hot exhaust gas stream exiting the turbine section. The current trend in engine development is towards improving thrust and efficiency through increased turbine exit temperatures which not only results in increased thermal stresses but also subjects the reheat components to a general environment significantly more hostile towards metal alloy materials. Carbon/carbon and ceramic composite materials are less susceptible to attack.

A major problem resulting from use of the substitute materials mentioned above arises because of the substantial differential thermal expansion that exists between the metallic and non-metallic materials. The mounting arrangement which will now be described is intended to compensate for this and also to be tolerant of slight annular misalignment of the components.

The turbine exhaust nozzle 10 terminates at its downstream end in an annular flange 12 formed by the margin of the nozzle turned radially outwardly through a right angle. The annular support structure 4 also includes a right angled portion formed by an axial annular portion 14 and an outwardly turned flange portion 16. The upturned nozzle margin 10,12 and the portions 14,16 of the support 4 are formed with corner radii such that the support 4 abuts around the circumference of the nozzle.

An angled mounting plate 18 is disposed on the back, that is the downstream side, of the outwardly turned flange 16 at each flameholder location. These plates 18 may be attached to or formed integrally with the annular support 4. The angled face of the plate 18 meets the flange 16 at about half flange height thereby forming an obtuse angle facing the axis of the jet pipe and into which the radially outer end of a flameholder 8 is located.

Figure 3:
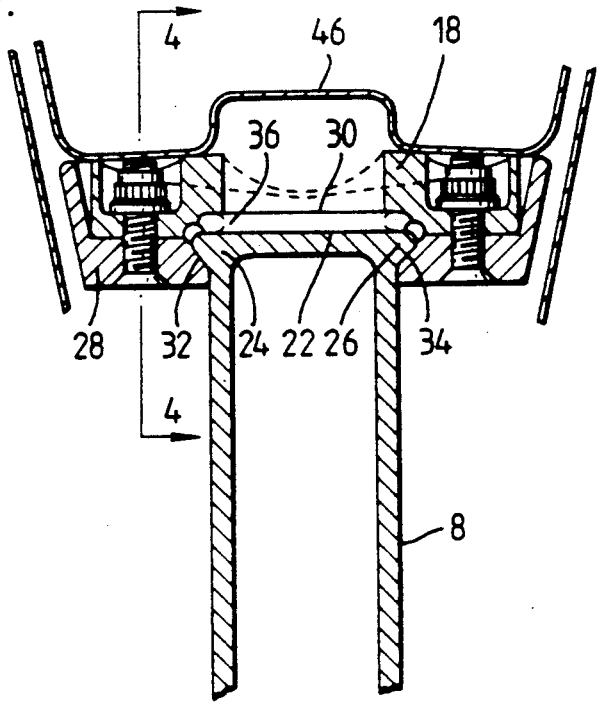
FIG. 3 shows an enlarged view, looking downstream, of part of a reheat system on section 3—3 of FIG. 4.
Figure 4:
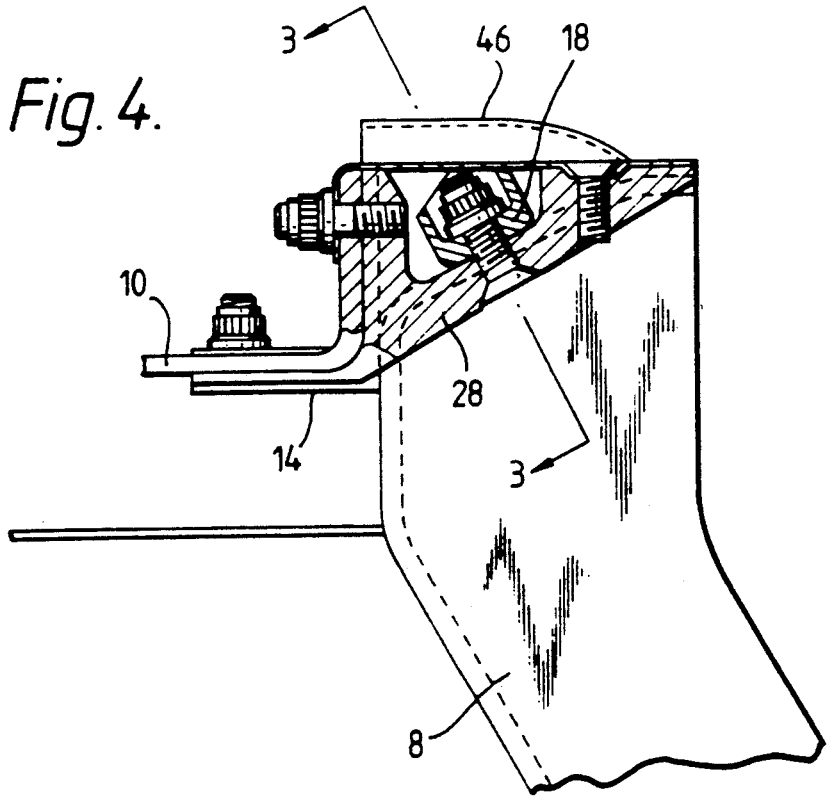
FIG. 4 shows a view on section 4—4 of FIG. 3.

The shape of the said outer end of a flameholder 8 will be readily apparent from the two sectional views at right angles of that component depicted in FIGS. 2 and 3. In the side view of FIG. 2 the flameholder is shown sectioned on a plane through the axis of the jet pipe. Visible in section are walls 20,22 at one end of the flameholder which also meet at an obtuse angle corresponding to the flange wall 16 and the seating face 30 of angled plate 18. The section view of FIG. 3 reveals the method by which the flameholder 8 is retained.

The side walls 24,26 at the end of the flameholder are flared outwardly to form a dovetail projection. This is done by progressively thickening the side walls towards the angled end face 22. The flameholder is offered up to the support annulus 4 with end wall 20 abutting flange 16 and angled wall 22 substantially parallel to the seating face 30 of plate 18. It is held in position by means of a retaining plate 28 bolted in place against the margin of plate 18.

The inward facing portion of retaining plate 28 is relatively thick and has a cut-out sufficiently wide to receive the flameholder 8, thereby providing locating members 32,34 on opposite sides of the flameholder. The opposing edges of members 32,34 are chamfered at angles to complement the flared ends 24,26 of the flameholder. When the plate 28 is bolted in position against plate 18 a dovetail recess is formed bounded by the angled faces of members 32,34 and the seating face 30.

The whole of the flameholder support structure 4 including angled seating plate 18 and retaining plate 28 are formed of metal or a high temperature metal alloy material. As previously mentioned gas temperatures in the jet pipe will reach temperatures above the normal operating limit of known metals or metal alloys. This metallic support structure is cooled by air exiting an engine by-pass duct between the liner 2 and turbine exhaust nozzle 10 in FIG. 2. The passage of this cooling air is indicated by the broad dotted arrows in FIG. 2 and will be described in more detail below.

The flameholders 8 project directly into the hottest regions of the turbine exhaust and therefore can reach temperatures which exceed considerably the maximum working temperatures of known metals and metal alloys. The solution adopted in the embodiment being described is to manufacture the flameholders of material capable of withstanding those temperatures. Carbon/-carbon, i.e. carbon fibre reinforced/carbon impregnated composite material, and silicon carbide reinforced ceramic material are two current examples of such materials. These materials share the common characteristic of coefficients of thermal expansion that are substantially lower than those possessed by metals and metal alloys. In the mounting arrangement described above, therefore, over the operational temperature range the relative dimensions of the dovetail projections on the flameholders and of the dovetail recesses on the support structure will change considerably.

This differential expansion is compensated by means of resilient C-section annular seal ring 36 which is sprung into a clearance region provided between the flameholder dovetail end face 22 and the seating face 30 in the mounting plate 18. This clearance region is preferably formed by the seating face 30 recessed in the plate 18. A circular recess is machined in the mounting face of plate 18 to receive the annular seal ring 36, the depth of the recess being less than the thickness of the seal ring. The wall of the machined recess need not comprise a complete circle, for example where the recess is cut by the edges of the plate, but is preferably of sufficient length to provide positive lateral location for the annular seal.

The seal 36 itself is formed by a metal or metal alloy capable of providing and retaining resilient properties over the operating range. The seal 36 although annular is not a complete toroid. In section it is C-shaped. The open part of the section faces radially inwards to form a circular opening in the seal. This serves two functions. First, the interior of the seal is open to receive a cooling air circulation. Second, it confers a degree of freedom of movement on the static ring which is thereby able to expand and contract in height according to the gap between the faces 30 and 22. As the seal is constructed of resilient material it always tends to expand to the maximum height permitted by this gap. The seal thus exerts a continual force against the dovetail end face 22 urging the angled dovetail faces into contact and providing at all times a positive locating force regardless of the amount of differential thermal growth which may have taken place. The resilience, and therefore compressibility of seal 36 also means that it is able to absorb minor misalignments between the faces 22, 30.

Cooling air from the engine by-pass duct is encouraged to circulate through the support structure by a plurality of apertures open to the by-pass flow. The flanges 12,16 on the exit nozzle 10 and support structure 4 have cooling air entry apertures 40,42 which duct air through mounting plates 18 and behind the flanges. The radial outer circumference of the reheat support structure also has a crenellated annular girdle 44 which provides scoops such as 46 to capture further quantities of cooling air for circulation through the structure. An internal baffle 48 may also be provided to encourage circulation of the cooling air into the recess region and interior of the seal 36.

We claim:

1. A dovetail assembly comprising:

a mounting structure having a first thermal expansion rate;

a plurality of slotted members each of which is detachably fixed to said mounting structure and is formed with a slot having angled locating faces and a first end face which define a dovetail recess, said plurality of slotted members defining a plurality of dovetail fixings;

a plurality of components having a second thermal expansion rate substantially different from said first thermal expansion rate, each of said components being formed with a second end face and angled adjacent sides which cooperate to form a dovetail projection, which for mounting is individually received into the dovetail recess of one of said slotted members, the relative dimensions of each of said slotted members and each said dovetail projection being such that an expansion gap is defined between each of corresponding pairs of said first and second end faces; and a resilient means interposed in each said expansion gap, between said first and second end faces of each of said corresponding pairs, operative to urge corresponding ones of said locating faces and said adjacent sides into engagement over a broad temperature range while absorbing differential thermal expansion.

2. A dovetail assembly as claimed in claim 1 wherein the resilient means is sprung into the dovetail recess to provide a preload force which maintains said corresponding ones of said locating faces and said adjacent sides in mutual contact.

3. A dovetail assembly as claimed in claim 2 wherein the resilient means comprises a resilient ring.

4. A dovetail assembly as claimed in claim 3 wherein said resilient ring has a C-shaped cross section with an open side facing radially inwardly with respect to a circumference of said ring.

5. A dovetail assembly as claimed in claim 4 wherein the first end face of each said dovetail recess is formed with an aperture whereby a cooling fluid may reach the interior of the resilient ring.

6. A mounting assembly comprising:

a metallic mounting structure;

a plurality of slotted members each of which is detachably fixed to said mounting structure and is formed with a slot having angled locating faces and a first end face which define a dovetail recess, said plurality of slotted members defining a plurality of dovetail fixings;

a plurality of non-metallic components, each of said components being formed with a second end face and angled adjacent sides which cooperate to form a dovetail projection, which for mounting is individually received into the dovetail recess of one of said slotted members, the relative dimensions of each of said slotted members and each said dovetail projection being such that an expansion gap is defined between each of corresponding pairs of said first and second end faces; and a resilient means interposed in each said expansion gap, between said first and second end faces of each of said corresponding pairs, operative to urge corresponding ones of said locating faces and said adjacent sides into engagement over a broad temperature range while absorbing differential thermal expansion.

7. A mounting assembly as claimed in claim 6 wherein the resilient means comprises a metallic ring having resilient properties to provide a preload force which maintains said corresponding ones of said locating faces and said adjacent sides in mutual contact.

8. A mounting assembly as claimed in claim 7 wherein said resilient ring has a C-shaped cross section.

9. A mounting assembly as claimed in claim 8 wherein the metallic mounting structure is formed with an aperture in a region of the first end face of each said dovetail recess whereby a cooling fluid may reach the interior of the resilient ring.

10. A gas turbine engine having a jet pipe containing a reheat system, said reheat system comprising:

an annular metallic support structure mounting in the jet pipe;

a plurality of slotted members spaced apart around the structure, each of said slotted members being detachably fixed to said support structure and being formed with a slot having angled locating faces and a first end face which define a dovetail recess, said plurality of slotted members defining a plurality of dovetail fixings;

a plurality of non-metallic flameholders, each of said flameholders comprising an elongate shaped member formed at one end with a second end face and angled adjacent sides which cooperate to form a dovetail projection, which for mounting is individually received into the dovetail recess of one of said slotted members, the relative dimensions of each of said slotted members and each said dovetail projection being such that an expansion gap is defined between each of corresponding pairs of said first and second end faces; and a resilient means interposed in each said expansion gap, between said first and second end faces of each of said corresponding pairs, operative to urge corresponding ones of said locating faces and said adjacent sides into engagement over a board temperature range while absorbing differential thermal expansion.

11. A gas turbine engine as claimed in claim 17 wherein the resilient means comprises a resilient ring.

12. A gas turbine engine as claimed in claim 11 wherein the said resilient ring has a C-shaped cross section.

13. A gas turbine engine as claimed in claim 12 wherein the said resilient ring is formed of a resilient metallic material.

14. A gas turbine engine as claimed in claim 13 wherein the metallic support structure is formed with an aperture in a region of each dovetail recess whereby cooling fluid may reach the interior of the resilient ring.

* * * * *